US008089206B2

(12) United States Patent
Wei et al.

(10) Patent No.: US 8,089,206 B2
(45) Date of Patent: Jan. 3, 2012

(54) FIELD EMISSION CATHODE AND FIELD EMISSION DISPLAY EMPLOYING WITH SAME

(75) Inventors: Yang Wei, Beijing (CN); Peng Liu, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 250 days.

(21) Appl. No.: 12/384,232

(22) Filed: Apr. 2, 2009

(65) Prior Publication Data

US 2010/0007263 A1 Jan. 14, 2010

(30) Foreign Application Priority Data

Jul. 9, 2008 (CN) ..... 200810068374

(51) Int. Cl.
*H01J 17/49* (2006.01)

(52) U.S. Cl. ..... 313/497; 313/495

(58) Field of Classification Search ..... 313/495–497
See application file for complete search history.

(56) References Cited

U.S. PATENT DOCUMENTS

| | | | | |
|---|---|---|---|---|
| 6,239,547 | B1 | 5/2001 | Uemura et al. | |
| 6,297,592 | B1 | 10/2001 | Goren et al. | |
| 6,864,162 | B2 | 3/2005 | Jin | |
| 6,911,767 | B2 | 6/2005 | Takai | |
| 7,173,366 | B2 | 2/2007 | Choi et al. | |
| 7,932,477 | B2 | 4/2011 | Wei et al. | |
| 2002/0175618 | A1 | 11/2002 | Lee et al. | |
| 2004/0095050 | A1 | 5/2004 | Liu et al. | |
| 2005/0040090 | A1 | 2/2005 | Wang et al. | |
| 2006/0061257 | A1 * | 3/2006 | Nakamoto | 313/496 |
| 2008/0122335 | A1 * | 5/2008 | Liu et al. | 313/292 |

FOREIGN PATENT DOCUMENTS

| | | | |
|---|---|---|---|
| CN | 1433039 | A | 7/2003 |
| CN | 1501422 | | 6/2004 |
| CN | 101192490 | A | 6/2008 |

* cited by examiner

*Primary Examiner* — Anne Hines

(74) *Attorney, Agent, or Firm* — Altis Law Group, Inc.

(57) ABSTRACT

A field emission display includes a field emission cathode and an anode electrode plate arranged above the field emission cathode. The filed emission cathode includes a substrate, and a plurality of electron-emitting areas spaced apart from each other and arranged on the substrate. Each of the electron-emitting areas includes a cathode, a gate electrode, and a number of first and second conductive lines. The cathode includes a first conductive substrate and a first carbon nanotube assembly having a plurality of carbon nanotubes each having a cathode emitting end having a needle-shaped tip. The gate electrode is faced to the cathode emitting end. The taper-shaped tips of the cathode emitting ends and the gate have a small size and higher aspect ratio, allowing them to bear a larger emission current at a lower voltage.

19 Claims, 7 Drawing Sheets

FIELD EMISSION CATHODE AND FIELD EMISSION DISPLAY EMPLOYING WITH SAME

RELATED APPLICATIONS

This application is related to applications entitled, "CARBON NANOTUBE EMITTER AND METHOD FOR MANUFACTURING SAME", filed on Apr. 2, 2009, (application Ser. No. 12/384,243). The disclosure of the above-identified application is incorporated herein by reference.

BACKGROUND

1. Technical Field

The present disclosure relates to field emission displays.

2. Description of the Related Art

A field emission display is a device representing an image through cathode luminescence of a phosphor. This is done by colliding electron emitted from the field emitter of a cathode plate against the phosphor of an anode plate, wherein the cathode plate having the field emitter and the anode plate with the phosphor are formed to be opposite to each other and separated by a given distance (for example, 2 mm). Recently, progress has been made in research and developments of the field emission display as a flat display capable of replacing the conventional cathode ray tube (CRT). Electron emission efficiency in the field emitter is variable depending on a device structure, emitter material and a shape of the emitter.

The structure of the field emission display can be mainly classified into a diode type with a cathode (or emitter) and an anode, and a triode type with a cathode, a gate and an anode. Metal, silicon, diamond, diamond-like carbon, carbon nanotube, and the like are usually used as the emitter material. In general, metal and silicon are used for the triode structure, and diamond, carbon nanotubes, etc. used for the diode structure.

The diode field emitter is usually formed from diamond. The diode field emitter has advantages in simplicity of the manufacturing process and high reliability of the electron emission, even though it has disadvantages in controllability of the electron emission and low-voltage driving, compared with the triode field emitter.

FIG. 7 is a perspective view schematically illustrating the construction of a conventional field emission display having a diode field emitter. A cathode plate has cathode electrodes 61 arranged in a belt shape on a lower glass substrate 60 and film-shaped field emitter materials 62 on a portion of there. An anode plate has transparent anode electrodes 64 arranged in a belt shape on an upper glass substrate 65 and phosphors 63 of red (R), green (G) and blue (B) on a portion of there. The cathode plate and the anode plate are vacuum packaged in parallel, while facing each other, by means of using spacers 66 functioning as a supporter. The cathode electrodes 61 of the cathode plate and the transparent anode electrodes 64 of the anode plate are arranged to intersect each other. In the above, an intersecting region is defined as one pixel. In the field emission display shown in FIG. 7, the electric field required for electron emission is given by the voltage difference between the cathode electrodes 61 and the anode electrodes 64. It has been noted that electron emission usually occurs in the field emitter when the electric field is applied to the field emitter material in the value more than 0.1 V/μm.

In particular, in the field emission display having the diode field emitter of FIG. 7, although the voltage for electron emission may be lowered by reducing the distance between the anode plate and the cathode plate, low voltage driving is nearly impossible since the anode electrode plate 64 is used as the acceleration electrode of the electron as well as the signal line of the field emission display. In the field emission display, a high-energy electron over 200 eV is required to emit the phosphor. The higher the electron energy is, the better the luminous efficiency is. Thus, a high-brightness field emission display can be obtained only at the cost of applying a high voltage to the anode electrode.

What is needed, therefore, is a field emission display having high-brightness with a lower voltage.

BRIEF DESCRIPTION OF THE DRAWINGS

The present field emission cathode and field emission display employed with the field emission cathode are described in detail hereinafter, by way of example and description of an exemplary embodiment thereof and with references to the accompanying drawings, in which.

DETAILED DESCRIPTION

A detailed explanation of a field emission cathode and a field emission display employed with the same according to an exemplary embodiment will now be made with references to the drawings attached hereto.

Figure 1:
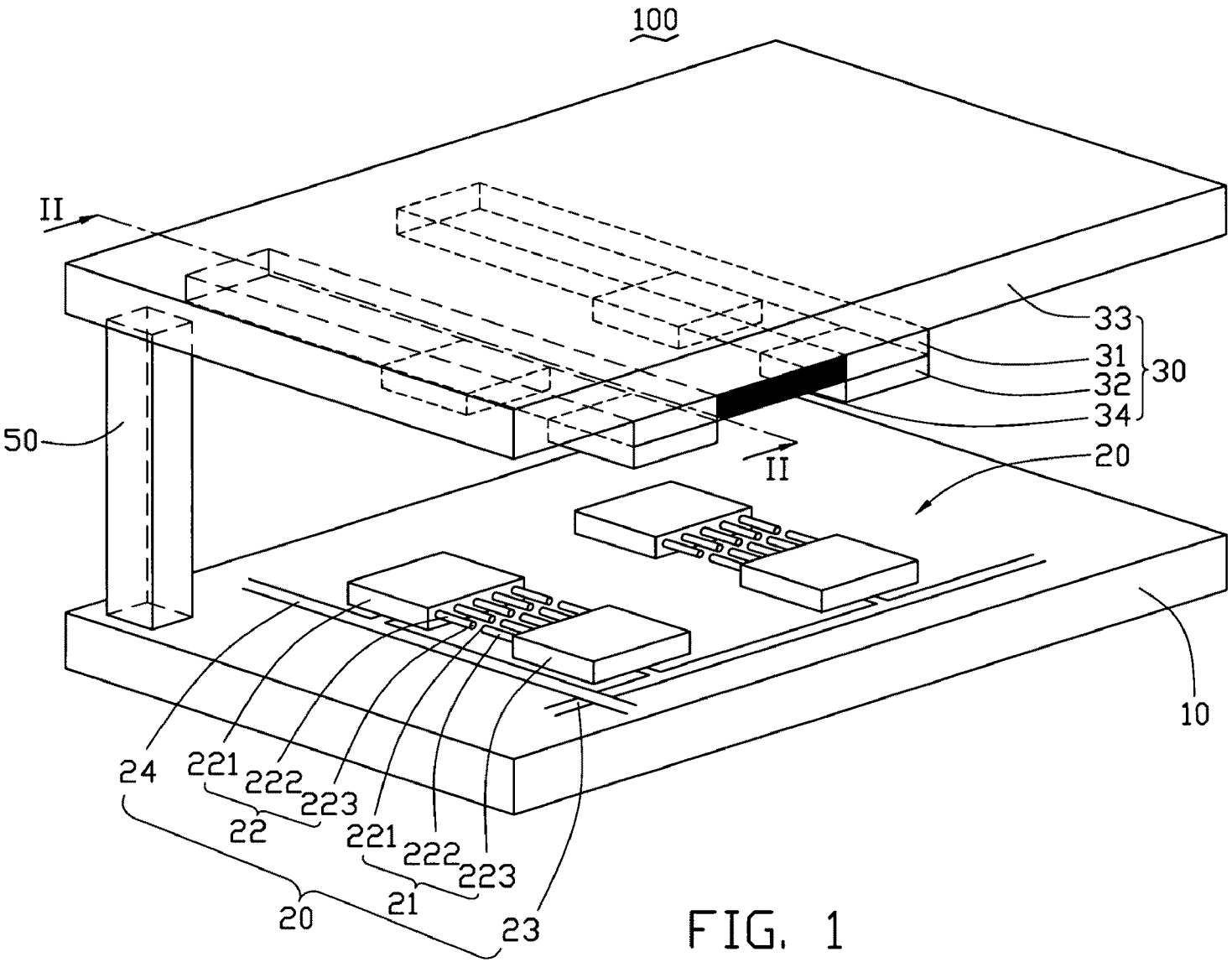
FIG. 1 is a schematic view of a field emission display employed with a field emission cathode having a carbon nanotube emitter according to an exemplary embodiment.
Figure 2:
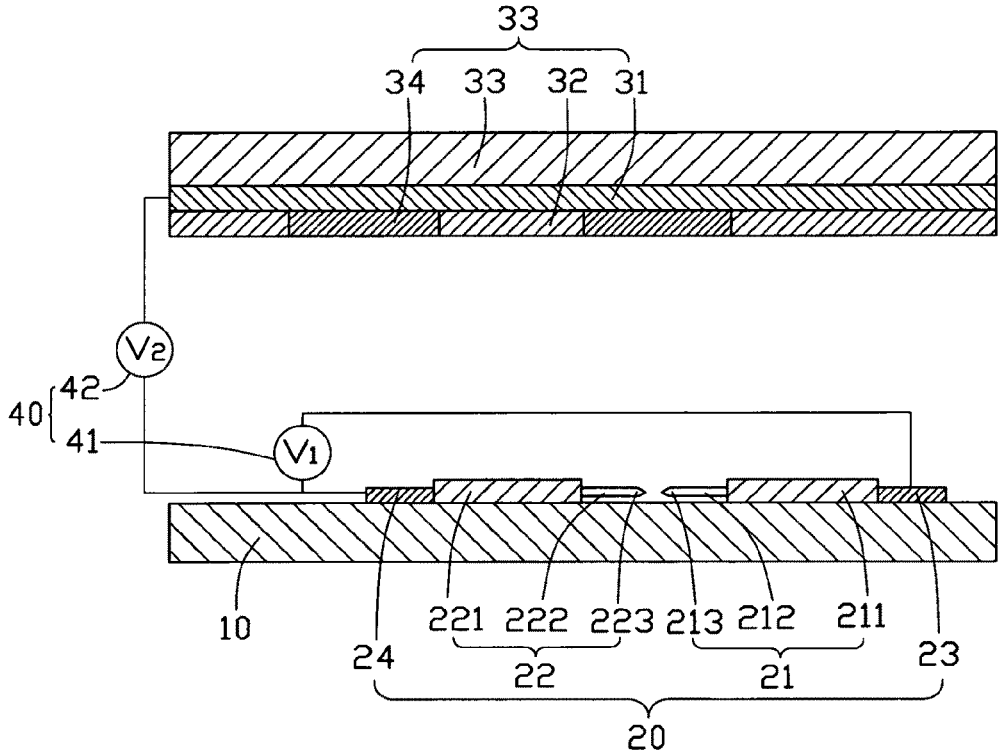
FIG. 2 is a schematic, cross-sectional view of the field emission display of FIG. 1 along the line II-II, which is added a circuit assembly.

Referring to FIGS. 1-2, a field emission display 100 according to an exemplary embodiment is shown. The field emission display 100 includes a substrate 10, a plurality of electron-emission areas 20 disposed on the substrate 10, and an anode electrode plate 30. The anode electrode plate 30 is disposed spaced a predetermined distance from the substrate 10, with the space therebetween being maintained under vacuum.

It should be noted that the field emission display 100 further includes a circuit assembly 40. The circuit assembly 40 is shown in FIG. 2. Referring also to FIG. 2, the circuit assembly 40 is electrically connected to the electron-emission areas 20 and the anode electrode plate 30 for applying a negative potential or a positive potential thereto. The circuit assembly 40 includes a first circuit 41 and a second circuit 42. The first circuit 41 is connected to the gate electrode 22 and the cathode 21 for inducing electrons to be emitted from the cathode 21. The second circuit 42 is connected to the anode electrode plate 30 and the gate electrode 22 for further accelerating the electrons emitted from the cathode 21. In use, a DC voltage $V_1$ of about 50V to about 1500V from the first circuit 41 can be applied to the gate electrode 22 to induce an electron emission from the cathode 21. At the same time, the emitted electrons are accelerated with high energy by applying a high voltage $V_2$ of above 2 kV to the transparent electrode 31 of the anode electrode plate 30.

The substrate 10 is be made of insulating material, such as glass, ceramic, resin, or the like, or some light polymer resin, such as tetrafluorethylene (TFE) for further reducing weight of the field emission display 100 as desired.

The electron-emission areas 20 are spaced apart from each other at a predetermined distance. Each of the electron-emission areas 20 is defined as one pixel to form an image. Each electron-emission areas 20 includes a cathode 21, a gate electrode 22, a plurality of first conductive lines 23, and a plurality of second conductive lines 24. The gate electrode 22 is positioned to lie in a common plane with the cathode 21. The first conductive lines 23 are arranged on the substrate 10 and electrically connected to each cathode 21. The second conductive lines 24 are arranged on the substrate 10 and electrically connected to each gate electrode 22 and insulated from the first conductive lines 23. Negative potential can be applied to the cathode 21, while positive potential is applied to the anode electrode plate 30 and the gate electrode 22, thereby allowing electrons to be emitted from the cathode 21 toward the anode electrode plate 30.

The cathode 21 includes a cathode conductive substrate 211 and a cathode carbon nanotube assembly 212 fixed on the sidewall of the cathode conductive substrate 211. The first conductive substrate 211 may be an electrode made of copper, tungsten, gold, molybdenum, platinum, ITO glass, or the like. Alternatively, the cathode conductive substrate 211 may be an insulating sheet, such as a silicon sheet, coated with a metal film with a predetermined thickness. The metal film maybe one of, but limited to, an aluminum (Al) film, silver (Ag) film or the like. In the present embodiment, the cathode conductive substrate 211 is a silicon sheet coated with an Al film and configured for supporting and electrically connecting to the cathode carbon nanotube assembly 212.

Figure 3:
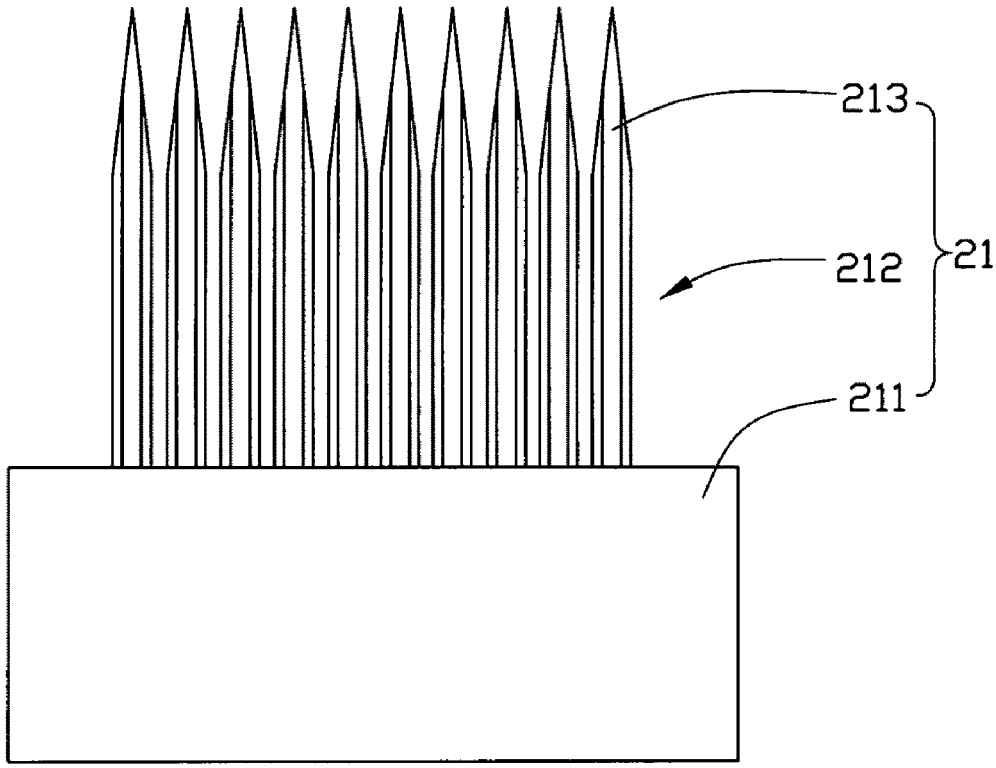
FIG. 3 is a schematic view of the carbon nanotube emitter of FIG. 1.
Figure 4:
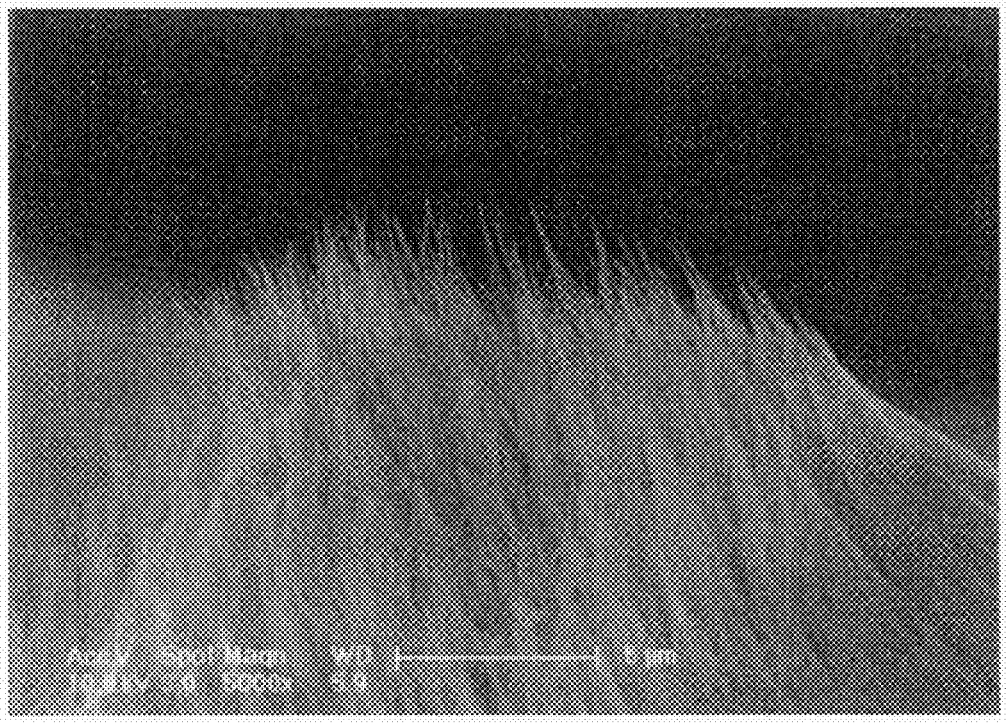
FIG. 4 is a scanning electron microscope (SEM) image of the carbon nanotubes emitter of FIG. 1.
Figure 5:
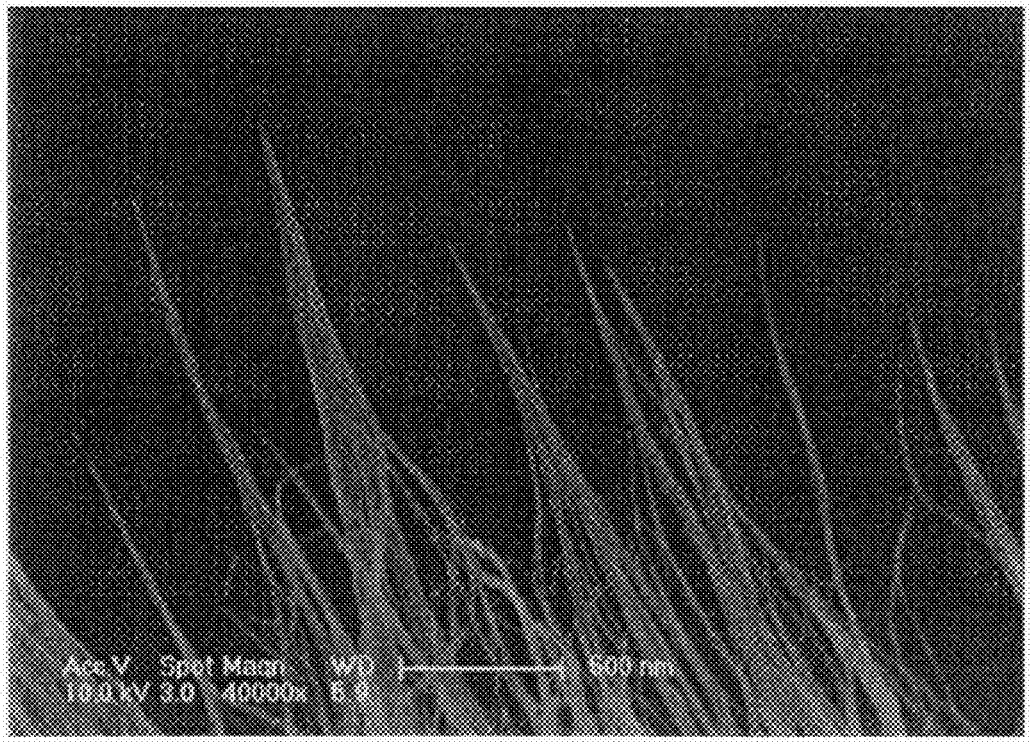
FIG. 5 is a scanning electron microscope (SEM) image of the taper-shaped tip of the carbon nanotubes of FIG. 1.

The cathode carbon nanotube assembly 212 is fixed on the cathode conductive substrate 211 by van der Waals force. For enhancing a fastening force between the cathode carbon nanotubes assembly 212 and the cathode conductive substrate 211, the cathode carbon nanotube assembly 212 may be further fixed to the cathode conductive substrate 211 via a conductive adhesive or metal-bonding. The cathode carbon nanotube assembly 212 includes a plurality of carbon nanotubes. The carbon nanotubes may be single-walled carbon nanotubes (SWCNT), double-walled carbon nanotubes (DWCNT), or multi-walled carbon nanotubes (MWCNT), or their mixture. Referring also to FIG. 3, each of the carbon nanotubes has an approximately same length and includes a cathode emitting end 213 as a field emitter distanced from the cathode conductive substrate 211 and having a needle-shaped tip (not labeled). The needle-shaped tip is employed as an electron emitting source of the electron-emission areas 20. Understandably, the entire carbon nanotubes may become a needle-shaped or a taper during breaking (breaking method of carbon nanotubes is shown in related application Ser. No. 12/384,243). Thus, the entire carbon nanotubes are employed as cathode emitting ends. In the present embodiment, each of the carbon nanotube includes a body (not labeled) and a cathode emitting end 213 defined from the taper to the end thereof. Each carbon nanotubes generally has a diameter in a range from about 0.5 nm to about 50 nm and a length in a range about 100 μm to about 1 mm. A distance between the tips of cathode emitting end 213 of two adjacent carbon nanotubes ranges from about 0.1 nm to about 5 nm. In the present embodiment, referring to FIG. 4, the carbon nanotubes each is a SWCNT having a gradually tapering diameter with a length of about 150 mm. As shown in FIG. 5, any two adjacent carbon nanotube cathode emitting ends 213 are spaced from each other by a distance greater than that of between the bases of the carbon nanotube which are connected to the cathode conducting substrate 211, diminishing screening effect between adjacent carbon nanotubes.

The gate electrode 22 is configured for inducing the cathode 21 to emit electrons while a current is applied between the cathode 21 and the gate electrode 22. The gate electrode 22 has a substantially same configuration as the cathode 21 and includes a gate conductive substrate 221 and a gate carbon nanotube assembly 222 fixed on the gate conductive substrate 221. The gate carbon nanotube assembly 222 includes a plurality of carbon nanotubes each having a gate end 223 distanced from the second conductive substrate 222 and also having a needle-shaped tip (not labeled). Similar to the cathode emitting end 213 of the cathode 21, the gate end 223 may be an entire carbon nanotube when the entire carbon nanotube has a lower length. In the present embodiment, the carbon nanotubes each is a SWCNT having a gradually tapering diameter along a direction away form the gate conductive substrate 221.

The first conductive lines 23 and the second conductive lines 24 may include signal lines (not shown), and addressing lines (not shown) and may form a belt shaped line disposed on the substrate 10. The first and second belt shaped conductive lines 23, 24 are made of a metal and enable row/column addressing and are electrically connected to the cathode 21 and the gate electrode 22, respectively. In the present embodiment, the first conductive lines 23 each are orthogonal to each of the second conductive lines 24 for defining a unit pixel. Each pixel defines one electron-emission area 20.

The anode electrode plate 30 includes a plurality of transparent electrodes 31 relative to the electron-emitting areas 20, and phosphors 32 of red (R), green (G) and blue (B) formed on a portion of the transparent electrode 31, on a transparent insulating substrate 33 made of glass, plastic, various ceramics, or the like. The anode electrode plate 30 also includes a number of black matrixes 34 formed between the phosphors 32.

It should be explained that the cathode emitting end 213 of the cathode 21 are parallel to the phosphor 32 of the anode 30, while facing each other, by means of using spacers 50 for support. The spacers 50 can be manufactured by glass beads, ceramics, polymer, etc. and may have a height in the range of about 200 μm to about 3 mm.

Figure 6:
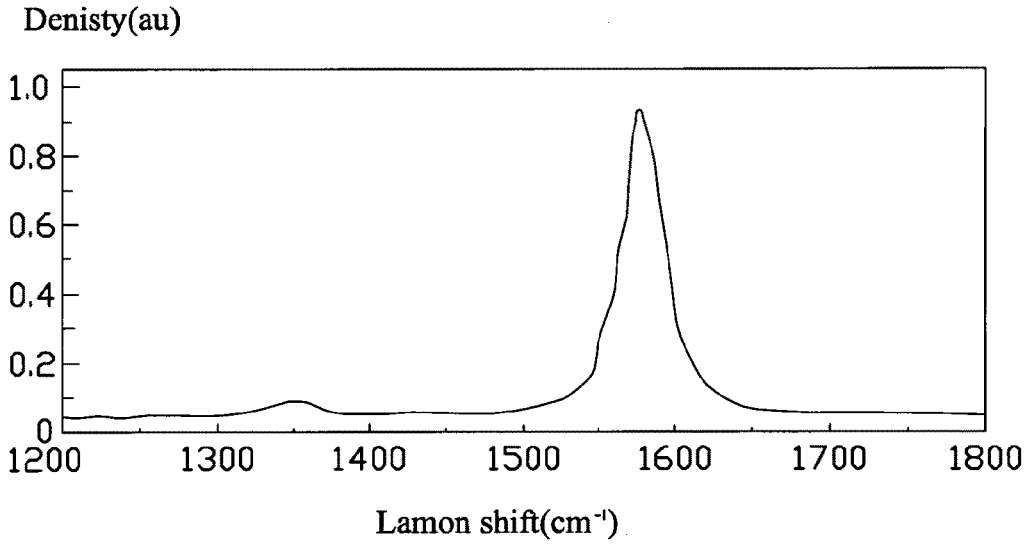
FIG. 6 is a Raman spectrum graph of the carbon nanotube emitter of FIG. 1.
Figure 7:
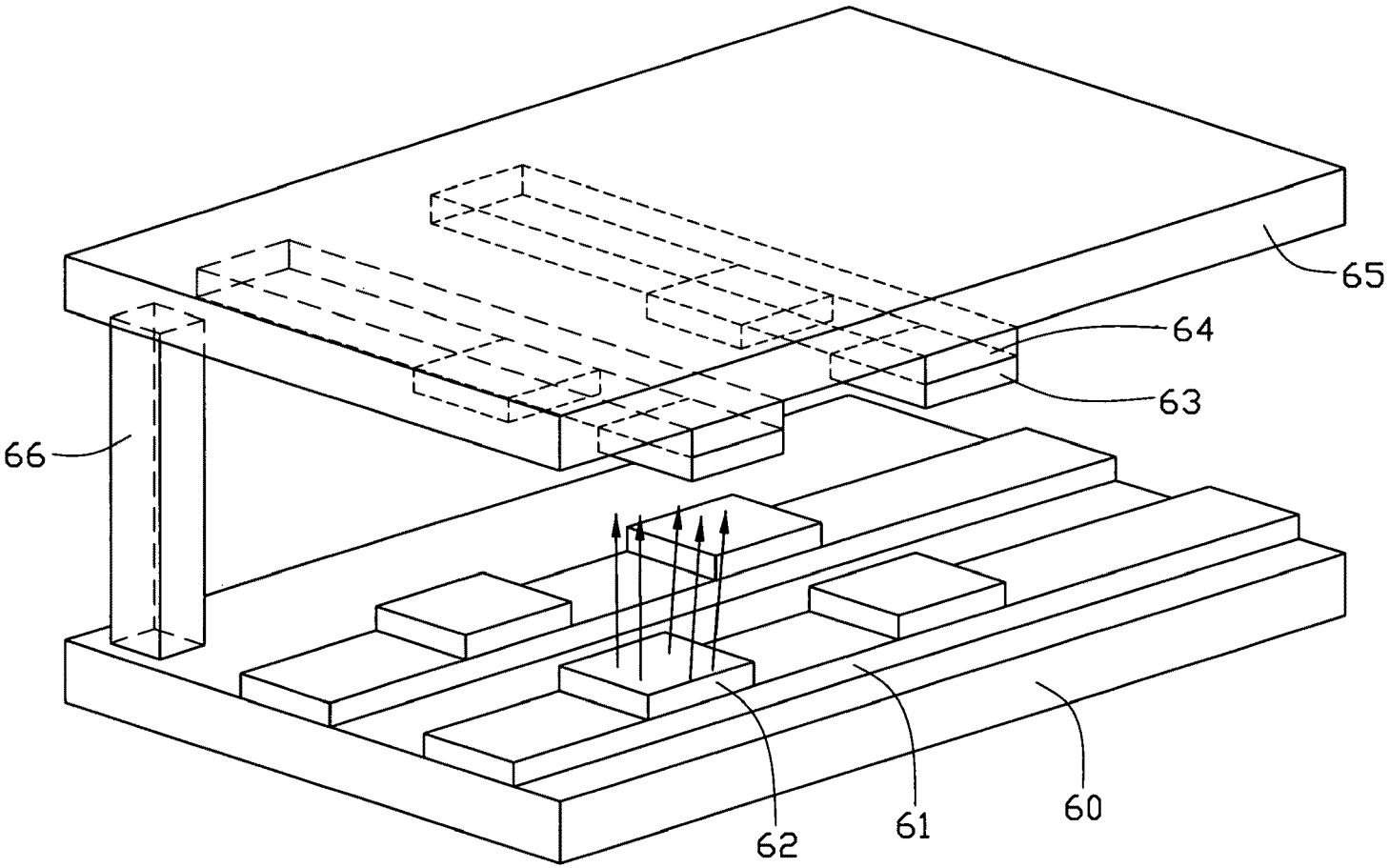
FIG. 7 (RELATED ART)
FIG. 7 is a perspective view schematically illustrating the construction of a conventional field emission display having a diode field emitter according to the prior art.

In the field emission display 100 according to the present embodiment, screening effect between adjacent carbon nanotubes is diminished. And the needle-shaped tip of the cathode emitting end 213 of the carbon nanotube, as shown in FIG. 6, has a lower size and higher aspect ratio than the typical carbon nanotubes, allowing a larger emission current at a smaller voltage. Therefore, a high-brightness field emission display can be obtained with less voltage applied to the cathode.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A field emission cathode, comprising:

a substrate; and a plurality of electron-emitting areas apart from each other and arranged on the substrate, each of the electron-emitting areas comprising:

a cathode comprising a cathode conductive substrate and a cathode carbon nanotube assembly, the cathode carbon nanotube assembly comprising a plurality of first tapered tips, wherein each of the plurality of first tapered tips comprises a plurality of first carbon nanotubes; and a gate electrode positioned to lie in a common plane with the cathode, the gate electrode comprising a gate conductive substrate and a gate carbon nanotube assembly, the gate carbon nanotube assembly comprising a plurality of second tapered tips, wherein each of the plurality of second tapered tips comprises a plurality of second carbon nanotubes, the gate carbon nanotube assembly and the cathode carbon nanotube assembly are directed towards each other.

2. The field emission cathode as claimed in claim 1, wherein the carbon nanotubes of both the cathode and the gate electrode have a length ranging from about 100 μm to about 1 mm.

3. The field emission cathode as claimed in claim 1, wherein a dimension of the carbon nanotubes of the cathode and the gate electrode are in a range from about 30 μm to about 70 μm.

4. The field emission cathode as claimed in claim 1, wherein a distance between two adjacent first tapered tips ranges from about 50 nm to about 500 nm.

5. The field emission cathode as claimed in claim 1, wherein a distance between two adjacent second tapered tips ranges from about 50 nm to about 500 nm.

6. The field emission cathode as claimed in claim 1, wherein a diameter of the carbon nanotubes of the cathodes and the gate electrodes are in a range from about 0.5 nm to about 50 nm.

7. The field emission cathode as claimed in claim 1, wherein each of the plurality of first carbon nanotubes has a first tapered end.

8. The field emission cathode as claimed in claim 1, wherein each of the plurality of second carbon nanotubes has a second tapered end.

9. The field emission cathode as claimed in claim 1, wherein the conducting substrate of both the cathode and the gate electrode comprises a material selected from the group consisting of copper, tungsten, aurum, molybdenum, platinum, and combinations thereof.

10. The field emission cathode as claimed in claim 1, wherein one of the plurality of first carbon nanotubes is protruded from others, one of the plurality of second carbon nanotubes is protruded from of the plurality of first tapered tips.

11. A field emission display, comprising:

a field emission cathode, comprising:

a substrate; and a plurality of electron-emitting areas apart from each other and arranged on the substrate, each of the electron-emitting areas comprising:

a cathode comprising a cathode conductive substrate and a cathode carbon, the cathode carbon nanotube assembly comprising a plurality of first tapered tips, wherein each of the plurality of first tapered tips comprises a plurality of first carbon nanotubes;

a gate electrode positioned to lie in a common plane with the cathode, the gate electrode comprising a gate conductive substrate and a gate carbon nanotube assembly, the gate carbon nanotube assembly comprising a plurality of second tapered tips, wherein each of the plurality of second tapered tips comprises a plurality of second carbon nanotubes, the gate carbon nanotube assembly and the cathode carbon nanotube assembly are directed towards each other; and an anode electrode plate arranged above the field emission cathode.

12. The field emission display as claimed in claim 11, wherein each of the plurality of first carbon nanotubes has a tapered end.

13. The field emission display as claimed in claim 11, wherein each of the plurality of second carbon nanotubes has a tapered end.

14. The field emission display as claimed in claim 11, wherein a distance between two adjacent first tapered tips ranges from about 50 nm to about 500 nm.

15. The field emission display as claimed in claim 11, wherein both the cathode and gate conductive substrates each comprises an insulation substrate and a conductive film located on a surface of the insulation substrate.

16. The field emission display as claimed in claim 15, wherein the conductive film comprises a material selected from the group consisting of copper, tungsten, aurum, molybdenum, platinum, and combinations thereof.

17. The field emission display as claimed in claim 11, further comprising a plurality of spacers disposed between the anode electrode plate and the field emission cathode.

18. The field emission display as claimed in claim 11, wherein a DC voltage in a range of about 50 to about 1500V is applied between the cathode and the gate electrode.

19. The field emission display as claimed in claim 11, wherein a DC voltage of over 2 kV is applied between the gate electrode and the anode electrode plate.

* * * * *